US010099909B2

(12) United States Patent
Steedley

(10) Patent No.: US 10,099,909 B2
(45) Date of Patent: Oct. 16, 2018

(54) AERIALIFT SAFETY DEVICE AND FALL RESTRAINT

(71) Applicant: Quanta Associates, LP, Houston, TX (US)

(72) Inventor: Steve Antonio Steedley, Buckley, WA (US)

(73) Assignee: Quanta Associates, L.P., Houston, TX (US)

( * ) Notice: Subject to any disclaimer, the term of this patent is extended or adjusted under 35 U.S.C. 154(b) by 33 days.

(21) Appl. No.: 15/155,784

(22) Filed: May 16, 2016

(65) Prior Publication Data

US 2016/0332856 A1 Nov. 17, 2016

Related U.S. Application Data

(60) Provisional application No. 62/161,967, filed on May 15, 2015.

(51) Int. Cl.
*B66F 11/04* (2006.01)
*B66F 17/00* (2006.01)

(52) U.S. Cl.
CPC ..... *B66F 17/006* (2013.01); *B66F 11/044* (2013.01)

(58) Field of Classification Search
CPC ..... B66F 17/006; B66F 11/044
See application file for complete search history.

(56) References Cited

U.S. PATENT DOCUMENTS

| | | | | |
|---|---|---|---|---|
| 6,297,744 | B1 | 10/2001 | Baillargeon | |
| 6,330,931 | B1 * | 12/2001 | Baillargeon | A62B 35/0037 182/18 |
| 6,486,788 | B1 | 11/2002 | Zagone | |
| 6,809,640 | B1 | 10/2004 | Sherman | |
| 7,106,205 | B2 | 9/2006 | Graef | |
| 7,448,925 | B2 | 11/2008 | Viggiano | |
| 8,408,360 | B2 | 4/2013 | Postma | |
| 8,928,482 | B2 | 1/2015 | Flynt | |
| 2003/0192738 | A1 * | 10/2003 | Gayetty | A62B 35/04 182/18 |
| 2007/0208491 | A1 | 9/2007 | Miller | |

(Continued)

*Primary Examiner* — Alvin C Chin-Shue
(74) *Attorney, Agent, or Firm* — Oathout Law Firm; Mark A. Oathout; Laura Tu

(57) ABSTRACT

Systems, methods and apparatus to increase the frequency and/or probability of use of a personal safety device, and to reduce the probability that a person is exposed to a dangerous situation unless and until a safety device has been engaged. One apparatus includes an alarm that is activated by the use of a mechanized instrument to remind a worker using the instrument to engage a safety device before proceeding to use the instrument, and an actuator for a switch that can be used by the worker to deactivate the alarm. Another apparatus includes a switch to prevent operation of a mechanized instrument unless a safety device is engaged by a worker using the device, and an actuator for a switch that can be used by the worker to permit operation of the instrument. In a mechanized instrument, another apparatus includes a plurality of sensors that measure distances between themselves, and a microprocessor to activate an alarm concerning engagement of a safety device before operation of the instrument and/or to prevent use of the instrument until a safety device is engaged.

10 Claims, 2 Drawing Sheets

(56) References Cited

U.S. PATENT DOCUMENTS

| | | | | |
|---|---|---|---|---|
| 2012/0217091 | A1* | 8/2012 | Baillargeon | G08B 21/02 182/18 |
| 2015/0019045 | A1 | 1/2015 | Holliday | |
| 2015/0027808 | A1* | 1/2015 | Baillargeon | B66F 17/006 182/3 |

* cited by examiner

AERIALIFT SAFETY DEVICE AND FALL RESTRAINT

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

TECHNICAL FIELD

This disclosure relates to systems for personal protection, and in particular systems for the protection of persons from dangers potentially associated with using mechanized instruments that typically have moveable components and/or from situations in which bodily restraint is needed such as for persons subjected to the hazard of falling.

BACKGROUND

Systems for personal protection are needed and utilized in many situations such as furnishing seat belts to protect the occupants of a vehicle or aircraft from being ejected from a secure position, or to shield consumers from improper use of a home appliance. Systems for personal protection are also needed in industry in various types of situations such as those in which workers operate or are exposed to mechanized instruments having moveable components such as power tools. Workers can be injured in situations in which bodily contact is made with the moveable components of a mechanized device or with debris thrown off by such a device in an industrial operation. In other situations, persons subjected to a risk of falling, such as those who climb walls, poles or towers, or those who work from scaffolds or the bucket of an aerialift truck, have a clear need for protection from the possibility of falling.

Protecting workers from the risk of falling has been a particular area of concern in industry because part of the success of any system designed to offer such protection depends in part on the fundamental question of whether it is in full and correct use by the worker once on the job. The best system of fall protection or restraint will not help if it is not being used.

Systems have thus been described in which, for example, persons using mechanized instrument are prevented from using the instrument unless and until a safety device is properly engaged. Of equal or greater interest and importance are systems that have been described in which persons exposed to the risk of falling are, for example, warned and reminded to engage safety belts and harnesses by sounding an alarm at the beginning of a job or activity. Such systems commonly accomplish that result through the use of electrical circuits created by giving a lanyard or harness belt conductive properties. In other systems, the hardware used for the purpose of attaching a safety belt or harness is itself characterized by the ability to measure optical or magnetic properties.

Other known systems related to furnishing personal safety protection are described in U.S. Pat. No. 6,809,640, U.S. Pat. No. 6,297,744, U.S. Pat. No. 6,330,931, U.S. Pat. No. 8,408,360 U.S. Pat. No. 8,928,482, U.S. Pat. No. 6,486,788, U.S. Pat. No. 7,106,205, U.S. Pat. No. 7,448,925, US 2007/0208491, and US 2015/0019045 the teachings of all of which are hereby incorporated by reference.

While known systems such as those described above offer admirable functionality, they frequently contemplate that the necessary capabilities are built into a mechanized instrument as originally manufactured. A need thus remains for systems, methods and apparatus that are designed to increase personal safety but that also offer the benefit of being more adaptable to a retrofit of existing equipment such that older, existing equipment can continue to be used but used with a greater degree of personal safety.

BRIEF SUMMARY

An object of the subject matter described herein is to furnish improvements useful for the purpose of addressing needs in the known technology, as described above, in addition to other purposes. This object is accomplished by the subject matter hereof in view of the fact that it furnishes systems, methods and apparatus to increase the frequency and/or probability of use of a personal safety device; and that it furnishes systems, methods and apparatus to reduce the probability that a person is exposed to a dangerous situation unless and until a safety device has been engaged.

In certain embodiments, various features of the subject matter hereof that accomplish such object include an alarm that is activated by the use of a mechanized instrument to remind a worker using the instrument to engage a safety device before proceeding to use the instrument, and an actuator for a switch that can be used by the worker to deactivate the alarm. Other features in other embodiments include a switch to prevent operation of a mechanized instrument unless a safety device is engaged by a worker using the device, and an actuator for a switch that can be used by the worker to permit operation of the instrument.

In further embodiments, other features are furnished that include, in a mechanized instrument, a plurality of sensors that measure distances between themselves, and a microprocessor to activate an alarm concerning engagement of a safety device before operation of the instrument and/or to prevent use of the instrument until a safety device is engaged.

The systems, methods and apparatus of the subject matter hereof furnish a desirable result and benefit in the form of increased use of safety devices by persons who are in potentially dangerous situations and/or need to use mechanized instruments that subject an operator to risk of injury. The systems, methods and apparatus hereof thus find utility in a variety of applications including bodily restraint in vehicles and aircraft, protection from injury from incorrect use of power tools or appliances, and protection of persons exposed to any type of situation involving a risk of falling.

BRIEF DESCRIPTION OF THE DRAWINGS

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION

Figure 1:
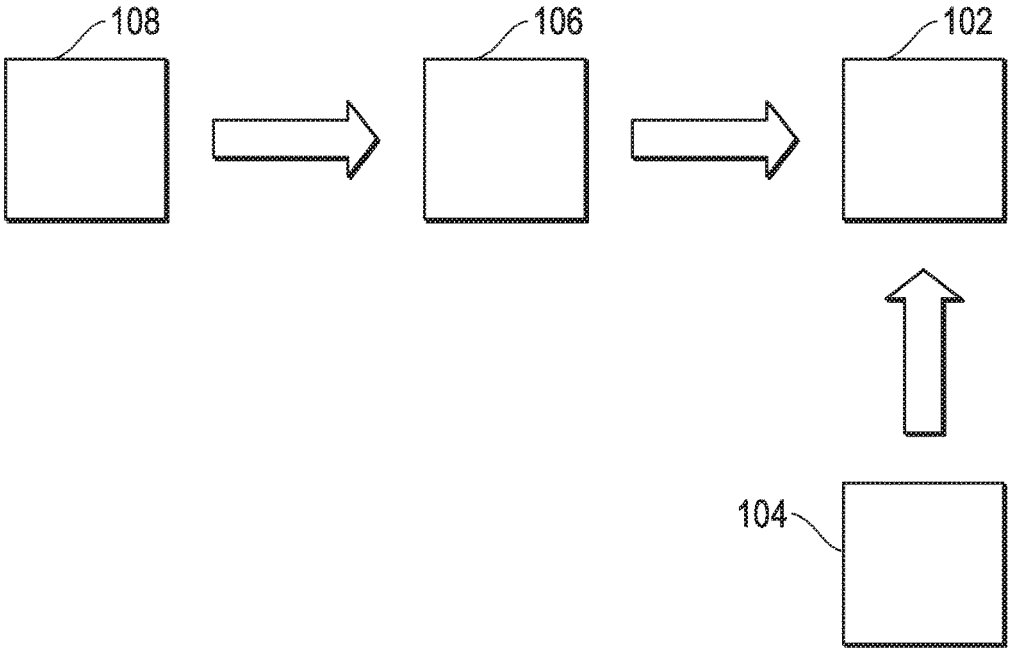
FIG. 1 shows a diagram of the interoperativity of the elements of a first embodiment of an apparatus hereof in which a switch deactivates an alarm.

The description that follows includes exemplary apparatus, methods, techniques, and instruction sequences that embody techniques of the inventive subject matter. However, it is understood that the described embodiments may be practiced without these specific details.

In one embodiment, the subject matter hereof includes systems, methods and apparatus to increase the frequency and/or probability of use of a personal safety device. In other embodiments, there is described herein systems, methods and apparatus to warn an operator of a dangerous instrument to engage a safety device before operation of the instrument. In other embodiments, there is described herein systems, methods and apparatus to reduce the probability that a person is exposed to a dangerous situation unless and until a safety device has been engaged.

Persons using safety devices as described herein include those using mechanized instruments; those riding in vehicles or aircraft; climbers of walls or elevated structures (such as steel workers, riggers or communication and power transmission tower climbers on steel structures, oil rigs, utility towers or other vertical surfaces); and workers riding on scaffolds, lift chairs or the bucket of an aerialift or boom.

Safety devices as utilized herein include covers or shields for mechanized instruments such as power tools; and also include restraints or fall protection equipment, such as that based, for example, on a tether system. A tether system includes a harness, an anchorage point, and a connecting device. A harness includes a device worn by a person such as a waist belt, a waist belt with suspenders, a lap and shoulder belt, a full body harness or a seat harness.

A secure structure furnishes an anchorage point, which is a point of engagement between the secure structure and the safety device or a connector between the safety device and the secure structure. A secure structure is, for example, the body of a mechanized instrument, the body of a vehicle or aircraft, a scaffold, a utility tower, or the bucket or boom of an aerialift. A secure structure furnishes a surface, frame or object having sufficient strength to hold a safety device in place, or to furnish personal restraint or fall arrest. Engagement between a cover or shield for a mechanized device and a secure structure is furnished by a locking mechanism to hold a shield or cover in place. Engagement between a harness and a secure structure is furnished by any of a variety of engagement fixtures such, particularly those having two inter-cooperating parts such as a clasp and buckle, or a hook (such as a carabineer) and D ring. A connecting device includes a lanyard, which is connected between a harness and an anchorage point. Suitable examples of a lanyard include a Y-lanyard, which has a single lanyard hook that attaches to a harness with the opposite end of the lanyard being divided into two straps, each with a lanyard hook for attaching to an anchorage point. In the example of one possible embodiment hereof, one part of two inter-cooperating parts in an engagement fixture can be attached to a safety device (such as a hook that protrudes from the end of a lanyard), and the other of the two inter-cooperating parts can be attached to a structure (such as the bucket of an aerialift truck).

A dangerous situation is one that could cause death of or injury to person, examples of which include situations in which a human body should be prevented from contact with a mechanized instrument such as a power tool, or from contact with debris generated by operation of a mechanized instrument; or a human body should be restrained or kept from falling. A mechanized instrument is a dangerous instrument that, when used improperly or carelessly could cause death of or injury to person; or that inherently exposes a person to a dangerous situation, such as work at a height at which falling could cause death or personal injury. A mechanized instrument often includes moveable components.

In another embodiment, the subject matter hereof includes an apparatus including (a) an alarm, (b) a sensor to activate the alarm, and (c) a switch to deactivate the alarm. In yet another embodiment hereof, there is included an apparatus including (a) an alarm, (b) a sensor to activate the alarm, and (c) a switch to deactivate the sensor. Both of the above described embodiments can further include (d) an actuator to operate the switch.

An alarm as utilized herein includes an alarm announcing itself by visual means, audible means or mechanical means, or any combination thereof. An alarm announcing itself by visual means produces, for example, a visual signal such as a steady light, a flashing light, a strobe light or a beacon light rotating at an adjustable speed. Suitable colors include red, amber, blue and green such as known for use on traffic warning devices or on emergency vehicles. LED or incandescent lamps can be used, and can operate on 12~120 volt AC or DC current at 25~200 watts. An alarm producing a visual signal may be preferred in situations involving high ambient noise levels where an audible signal may not be heard. Visual alarms such as those described above, and others suitable for use herein, are available, for example, from Ingram Products, Inc., Ashland, Ohio.

An alarm announcing itself by audible means produces, for example, a sound or other audible signal such as that made by a siren, ringing or gong or bell, buzzer, vibrating or resonating horn, which can be steady or intermittent. These devices can operate on 12~240 volts AC or DC current typically using less than 1 amp. They can produce a sound of 10 to 120 dB at 10 feet, and preferably produce a sound different from that typically associated with a vehicle in reverse gear that is backing up. Audible alarms such as described above, and others suitable for use herein, are available, for example, from W.W. Grainger, Inc., Lake Forest, Ill.

An alarm announcing itself by mechanical means produces, for example, a vibrating motion such as that known for use in a pager or mobile telephone. A mechanical alarm can be worn by a person who is, or likely could be, subjected to a dangerous situation, such as a device worn on the wrist where vibrations would be readily felt. Mechanical alarms such as those described above, and others suitable for use herein, are available, for example, from Microframe Corporation, Broken Arrow, Okla.

A sensor to activate an alarm can detect any one or more stimuli such as sound, motion, thermal energy, electromagnetic radiation, or optical or photoelectric content, or a combination thereof. A sensor detecting sound includes those, for example, that can receive ultrasonic waves that have been emitted and then reflected back from nearby objects. A sensor detecting thermal energy includes those, for example, that are sensitive to skin or other temperature through emitted black body radiation at mid-infrared wavelengths, in contrast to background objects at ambient temperature, such as a passive infrared sensor.

A sensor detecting optical or photoelectric content includes those, for example, that contain a light transmitter and receiver and that can detect any disruption or obstruction of the transmitted beam of light. Visible light, or infrared radiation that is not visible, can be generated by the transmitter. The device can be powered by standard DC or AC, or can use an infrared light-emitting diode modulated at a few kilohertz. A sensor detecting optical content also includes, for example, a digital video camera, which can be operated in an illuminated field, or in a non-illuminated field using near-infrared illumination.

A sensor detecting electromagnetic radiation includes those, for example, that emits a continuous wave of microwave radiation, and can detect phase shifts in the reflected microwaves. A sensor detecting electromagnetic radiation can also include a tomographic motion detection system, which can detect disturbances to radio waves as they pass from node to node of a mesh network.

A sensor detecting a physical force or stimulus includes those, for example, that contain an arm that incorporates a spring-loaded lever arm that is typically both the mechanical extension and the ground electrical connection of a normally open (off until pressed) momentary (on only while pressed) single-pole (one set of electrical contact points), single-throw (only one position conducts) switch. Moving the arm through a specified angle in any off-center direction causes the contacts to operate, but the coil spring causes the arm to return to its original position when the force or stimulus is withdrawn.

All of the sensors described above can be configured to detect motion, and to then convert the recorded event to an electrical signal that can be transmitted by the sensor to a receiver. For example, detection of the received field of ultrasonic waves can indicate motion, similar to the manner of operation of Doppler radar (which produces velocity data about objects at a distance by beaming a microwave signal towards a desired target, listening for its reflection, then analyzing how the frequency of the returned signal has been altered by the object's motion using the Doppler effect). Phase shifts in the reflected microwaves can indicate motion of an object toward (or away from) the receiver, also similar to the manner in which Doppler radar operates. A sensor that transmits a beam of light or other radiation can read any disruption or obstruction of the transmitted beam as motion.

Other sensors suitable for use herein, frequently referred to as proximity sensors, can also detect motion by detecting the presence, or corresponding absence, of nearby objects (a "target") without physical contact. One suitable type of a proximity sensor emits an electromagnetic field or a beam of electromagnetic radiation and then looks for changes in the return signal or field caused by the presence or absence of the target. Another suitable sensor or transmitter/reader type is a radio frequency (RF or RFID) chip which can be used to measure movements or motion wirelessly.

Different types of proximity sensors employ different kinds of media. For example, an inductive proximity sensor detects metallic objects by use of a coil and oscillator that creates an electromagnetic field in the close surroundings of the sensing surface. The presence of a metallic object (the target) in the operating area causes a dampening of the oscillation amplitude, and the rise or fall of such oscillation is identified by a threshold circuit that changes the output of the sensor. A capacitive proximity sensor detects metallic objects or nonmetallic objects (such as liquid, plastic or wood) by measuring the variation of capacitance between the sensor and the target. When the target is at a preset distance from the sensor, an electronic circuit inside the sensor begins to oscillate, and the rise or the fall of such oscillation is identified by a threshold circuit that drives an amplifier for the operation of an external load.

A magnetic proximity sensor is actuated by the presence of a permanent magnet. The presences of a magnetic field causes reed contacts, which have thin plates hermetically sealed in a glass bulb with inert gas, to flex and touch each other causing an electrical contact. A photoelectric sensor contains an emitter (light source) and a receiver, and detects light reflected directly off the target, detects the interruption of a reflected light by the target, or detects the interruption by the target of a light beam between the emitter and receiver. As noted above, an ultrasonic sensor can determine presence, proximity or distance by transmitting a short burst of ultrasonic sound toward the target, which reflects the sound back to the sensor. The system then measures the time for the echo to return to the sensor, and computes the distance to the target using the speed of sound in the medium.

Sensors such as any of those described above, and other alternatives suitable for use herein, can be obtained from a variety of sources including Rockwell Automation (Allen-Bradley), Milwaukee, Wis.; Honeywell, Morristown, N.J.; or RECON Dynamics, Kirkland, Wash.

A switch as utilized herein to deactivate an alarm or a sensor includes an electrical component that can break an electrical circuit, interrupting the current or diverting it from one conductor to another, suitable choices for which include a circuit breaker, mercury switch, wafer switch, surface mount switch, reed switch, toggle switch, in-line switch [including a DIP (dual in-line package) switch], push-button switch, rocker switch, and snap-action switch.

An actuator as utilized in the subject matter hereof is a component that applies the operating force or condition to the contacts in a switch to close or open a circuit, and can, for example, be any type of mechanical linkage such as a toggle, dolly, rocker, or push-button. Suitable types of actuators to control a mechanically-operated switch herein include those used, for example, in a rotary switch, which operates with a twisting motion of an operating handle with at least two positions, one or more positions of the switch being momentary (biased with a spring) requiring the operator to hold the switch in the position, or having a detent or cam to hold the position when released; or those used in a toggle switch, which is manually actuated by a mechanical lever, handle or rocking mechanism in which two arms, which are almost in line with each other, are connected with an elbow-like pivot; or those used in a knife switch, which consists of a flat metal blade, hinged at one end, with an insulating handle for operation, and a fixed contact through which current flows when the switch is closed.

Among the many other switches and actuators suitable for use herein are also included a capacitance or resistance touch switch, which can be operated by finger touch; or a Piezo touch switch, which is based on mechanical bending of piezo ceramic element, can be operated by any actuating implement that applies the appropriate compressive pressure on the piezo element to cause it to generate an electric charge. Yet other embodiments involve the use of a reed switch, in which a pair of contacts on ferrous metal reeds in a hermetically sealed glass envelope are operated by an applied magnetic field. The contacts may be normally open, closing when a magnetic field is present, or normally closed and opening when a magnetic field is applied. The magnetic field can be applied by an actuator in the form of an electromagnet, or in the form of a permanent magnet such as a metallic implement manually employed by a person, suitable forms of which would be a metal bead, disc, bar, cylinder, rod or pin. In such an embodiment, a reed switch can be installed in an apparatus having, or associated with, a housing designed to permit a metal rod or pin actuator to contact the location of the reed switch, and remain in contact with the switch until removed, for the purpose of creating the magnetic field necessary to open or close the circuit, as desired. In those embodiments or others disclosed elsewhere herein, the metallic implement (or other type of actuator in other embodiments) is separate from and external to the switch, and is thus not contained, housed or incorporated within the switch.

The sensor described above that is responsive to a physical force or stimulus can, moreover, be thought of as a multi-position switch includes a movable actuator rod projecting from one end of a housing and having a cylindrical contactor disc within the housing displaceable into a plurality of radial positions to actuate a selected one or a selected pair of circuits as the contactor engages and radially deflects adjacent ones of a plurality of resilient contacts arranged concentrically about the actuator rod. Switches such as these are in some instances referred to as a "whisker" or "wobble" switch.

Switches and actuators such as any of those described above, and other alternatives suitable for use herein, can be obtained from a variety of sources including Rockwell Automation (Allen-Bradley), Milwaukee, Wis.; or Honeywell, Morristown, N.J.

The output from a sensor, and the input to and/or the output from a switch, can be conveyed by conventional metal conductors, such as copper wire, as electromagnetic signals, or can be conveyed by fiber optic cables as pulses of light. Alternatively, such input and outputs can be conveyed wirelessly using radio frequency signals combined with, for example, RFID chip(s) used as a sensor (or transmitter/reader) to measure motion. Wireless communication requires a transmitter and a receiver, (or a transceiver); an antenna; and an energy source. A suitable energy source is a battery, either rechargeable or single use. Where more than one antenna is used in an application, it is preferred that each antenna operate on a unique, discrete frequency.

A transmitter converts a signal output by a sensor or switch into a radio transmission, and the radio signal serves as input to a receiver, which then converts the wireless signal to a specific, desired form of output, such as an analog voltage or current, DC pulse, a solid state relay, or a mechanical relays. Radio transmission can be on a frequency such as 915 MHz or 2.4 GHz, and data can be communicated in standard TCP/IP packets. In a preferred embodiment, a receiver functions as a controller to interpret the received signal and convert it into a desired output such as contact closure, analog output or digital display to manipulate a process; or to export data to software through a direct connection to a computer through a USB port, or to the internet through an embedded web server.

In the various embodiments hereof, a switch can thus be used to activate or deactivate an alarm or a sensor. The switch can accomplish such result by transmitting an electromagnetic signal to the alarm or sensor by conventional wired circuit, or wirelessly by radio frequency signals; or by transmitting a light pulse by means of an infrared transmitter/receiver. The actuator can control a switch that is normally closed, and by opening the switch prevent transmission of a signal; or can control a switch that is normally open, and by closing the switch enable the transmission of a circuit.

Figure 2:
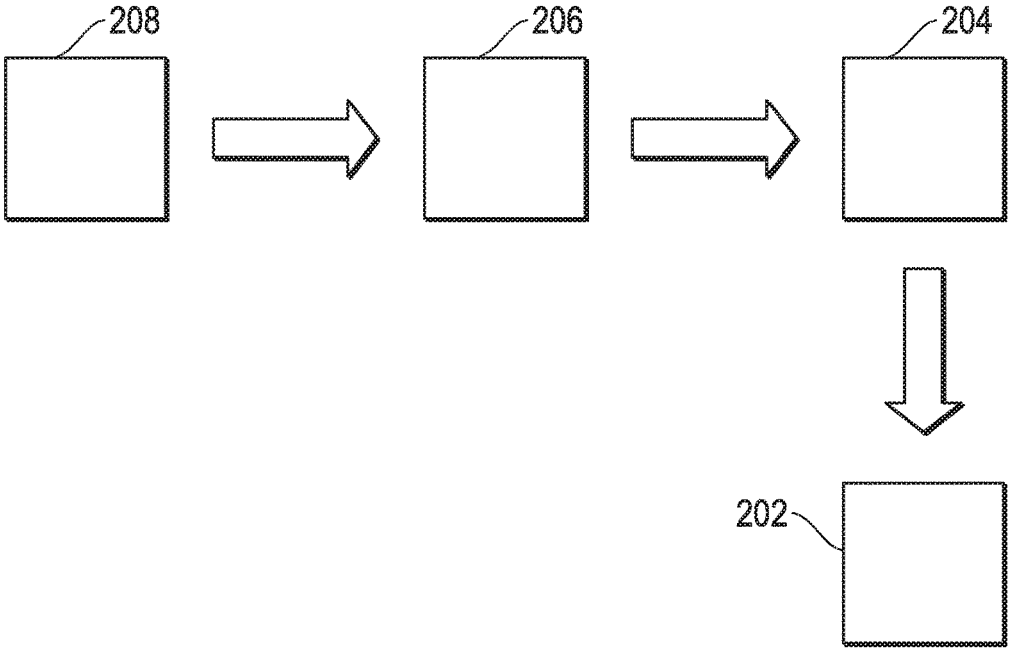
FIG. 2 shows a diagram of the interoperativity of the elements of a second embodiment of an apparatus hereof in which a switch deactivates a sensor.

In yet another embodiment of the subject matter hereof, the interoperativity of an alarm, a sensor, a switch, and an actuator is shown in FIG. 1 in which there is shown (a) an alarm 102, (b) a sensor 104 to activate the alarm 102, (c) a switch 106 to deactivate the alarm 102, and (d) an actuator 108 to operate the switch 106. In yet another embodiment hereof, the interoperativity of such components is shown in FIG. 2 in which there is shown (a) an alarm 202, (b) a sensor 204 to activate the alarm 202, (c) a switch 206 to deactivate the sensor 204, and (d) an actuator 208 to operate the switch 206. The block arrows between the elements in FIGS. 1 and 2 indicate the flow of communication and/or action between and among the elements to accomplish the stated operation. An alarm, sensor, switch and actuator, such as described hereinabove are suitable for use in the embodiments shown in FIGS. 1 and 2. Any sensor (or transmitter/reader) or switch herein may comprise, in exemplary embodiments, a radio frequency (RF or RFID) chip which can be used to measure movements or motion wirelessly.

In yet other embodiments of the subject matter hereof, there is described an apparatus that includes (a) an alarm to warn of a dangerous situation, (b) a switch to deactivate the alarm, (c) an actuator to operate the switch, and (d) an engagement fixture that engages a safety device with a structure at a point of engagement, wherein engagement of the safety device reduces the danger presented by the situation; and wherein the actuator constitutes a first component, and the engagement fixture constitutes a second, separate component. In embodiments such as those, or in variations thereon, the switch can further be external to the switch. An alarm, switch, actuator, safety device, structure and/or engagement fixture such as described above are suitable for use in these embodiments.

In particular embodiments of the subject matter hereof, the switch constitutes a first component, and the safety device constitutes a second, separate, physically discrete component. Such characteristics can arise in situations where, for example, operation of the switch is not involved in any manner with operation of the safety device, and vice versa; and/or the switch resides at a first location, and the point of engagement resides at a second location that is separate from the first location. Further, in those embodiments or alternatives thereof, the actuator is separate from and external to the switch, and is thus not contained, housed or incorporated within the switch. Further, in those embodiments or alternatives thereof, the actuator constitutes a first component, and the engagement fixture constitutes a second, separate, physically discrete component. Such characteristics can arise in situations where, for example, operation of the switch by the actuator is not involved in any manner with operation of the engagement fixture, and vice versa; and/or operation of the switch by the actuator does not engage the safety device, and engagement of the safety device does not operate the switch.

In certain variations of the embodiments such as described above in which an actuator constitutes a first component, and an engagement fixture constitutes a second, separate, physically discrete component, the actuator contacts the switch to operate the switch. The actuator can thus be placed in contact with the switch to operate the switch, and this can be done, for example, manually by the operator of a mechanized instrument. This can also be done in a manner such that the actuator contacts the switch but not the structure, i.e. it does not also contact the structure. In one embodiment, an actuator that creates a magnetic field is placed in contact with a reed switch, and a suitable actuator for such purpose is metallic instrument such as a bayonet pin. An actuator that is separate from a safety device, but that is deployed by being placed in contact with the switch, can, when not in contact with the switch, reside in an external location such as a carrier that makes the actuator readily accessible for use when needed. Such a carrier can, for example, be a holster, quiver, scabbard, sheath, bag, canister, pouch, purse, sack, clasp, hook, or other similar receptacle or holder. Such a carrier can be, but need not necessarily be, attached to or incorporated into a safety device or mechanized instrument, such as a holster attached to a lanyard, a holder attached to a tool belt, or a canister attached to a mechanized instrument. In such situations, the actuator itself thus remains separate from a safety device although the placement of the carrier makes the actuator readily accessible and easy to use.

In yet other embodiments of the subject matter hereof, there is described an apparatus that includes (a) an alarm to warn of a dangerous situation, (b) a switch to deactivate the alarm, and (c) a safety device that is engageable with a structure at a point of engagement and that, when engaged, reduces the danger presented by the situation; wherein the switch is mounted on the structure at a location separate from the point of engagement. Embodiments such as those, and variations thereof, can further include an actuator to operate the switch. An alarm, switch, actuator, safety device, and/or structure such as described above are suitable for use in these embodiments.

In yet other embodiments of the subject matter hereof, any of the apparatus as described above, or alternatives thereof, also include a sensor to activate the alarm. In some or all of those other embodiments, the switch can then be designed to alternatively deactivate the sensor, or to deactivate both the alarm and the sensor.

In yet other embodiments of the subject matter hereof, there is described an apparatus that includes (a) a dangerous instrument, (b) a switch to enable operation of the instrument, (c) an actuator to operate the switch, and (d) an engagement fixture that engages a safety device with a structure at a point of engagement, wherein engagement of the safety device reduces the danger presented by operation of the instrument; and wherein the actuator constitutes a first component, and the engagement fixture constitutes a second, separate component. An instrument, switch, actuator, safety device, and/or structure such as described above are suitable for use in these embodiments.

In yet other embodiments of the subject matter hereof, there is described an apparatus that includes (a) a dangerous instrument, (b) a switch to enable operation of the instrument, and (d) a safety device that is engageable with a structure at a point of engagement and that, when engaged, reduces the danger presented by operation of the instrument; wherein the switch is mounted on the structure at a location separate from the point of engagement. Embodiments such as those, and variations thereon, can further include an actuator to operate the switch. An instrument, switch, actuator, safety device, and/or structure such as described above are suitable for use in these embodiments.

In certain variations of the embodiments such as described above in which a switch enables the operation of a dangerous instrument, the switch can operate to furnish a lockout function, and the power supply to the instrument can thus be routed through a circuit that is normally open, and operation of the switch functions to close the circuit such that power is available to the instrument for operation. The requirement that the switch be closed to furnish power to the instrument to enable operation thereof will remind the operator of the instrument to engage the safety device before closing the switch to begin operation of the instrument.

In yet other embodiments of the subject matter hereof, there is described a kit that includes (a) an alarm, (b) a switch, (c) an actuator to operate the switch, and (d) a carrier for the actuator. In embodiments such as these or alternatives thereof, the kit as described above can also include a safety device and/or a sensor to activate the alarm. An alarm, switch, actuator, carrier, safety device and/or sensor such as described above are suitable for use in any of these embodiments of a kit herein. A kit as described above is useful for retrofitting an existing mechanized instrument with a safety device that, when engaged, reduces any danger that can be presented by operation of the instrument.

In yet other embodiments of the subject matter hereof, in a dangerous instrument that includes a movable component, there is described an apparatus that includes (a) a first sensor included in the instrument and a second sensor included in the movable component; (b) an alarm activatable in relation to movement of the movable component; (c) a safety device that is engageable with a structure and that, when engaged, reduces danger presented by movement of the component, wherein the safety device includes a third sensor and the structure includes a fourth sensor; (d) a switch to deactivate the alarm; and (e) a microprocessor (i) to calculate the distance of the third sensor from the fourth sensor, (ii) to calculate a change in the distance of the first sensor from the second sensor to detect movement in the movable part, and (iii) to instruct the switch to deactivate the alarm upon detecting movement of the movable part when the distance of the third sensor from the fourth sensor does not exceed a preselected value.

In yet other embodiments of the subject matter hereof, in a dangerous instrument that includes a movable component, there is described an apparatus that includes (a) a first sensor included in the instrument and a second sensor included in the movable component; (b) a switch to enable movement of the movable component; (c) a safety device that is engageable with a structure and that, when engaged, reduces danger presented by movement of the component, wherein the safety device includes a third sensor and the structure includes a fourth sensor; and (d) a microprocessor (i) to calculate the distance of the third sensor from the fourth sensor, (ii) to calculate a change in the distance of the first sensor from the second sensor to detect movement in the movable part, and (iii) to instruct the switch to enable movement of the movable part when the distance of the third sensor from the fourth sensor does not exceed a preselected value.

An instrument, sensor, switch, safety device and/or structure such as described above are suitable for use in the foregoing embodiments. Examples of the moveable component of a dangerous instrument can, in various embodiments, include the boom of aerialift truck; or the suspended scaffold platform of a scaffold assembly wherein the assembly includes the suspended platform, the cable on which the platform is suspended, and the support (such as stanchions, braces, davit crane or outrigger beams) that secures the cables on which the platform is suspended. In examples furnished by embodiments such as those, or variations thereon, the first sensor can be attached to the body or frame of an aerialift truck, or the support holding a suspended scaffold platform; and the second sensor can be attached to the boom of the aerialift truck, or the scaffold platform of the scaffold assembly.

The microprocessor calculates the distance of the third sensor from the fourth sensor, and instructs the switch to deactivate the alarm, or to enable movement of the movable part, when the distance of the third sensor from the fourth sensor does not exceed a preselected value. This is useful because, since the safety device includes the third sensor and the structure includes the fourth sensor, calculating the distance of the third sensor from the fourth sensor can indicate whether the safety device is engaged or not. Consider, for example, the case of a safety device that includes the lanyard of a harness, and a structure that includes a secure mooring such as the bucket of an aerialift truck or a scaffold platform. The safety device in such situation can include, for example, a two-part engagement fixture, such as a hook, and D ring that is secured to a structure. The close proximity of the third sensor on the portion of a lanyard from which the hook protrudes to the fourth sensor mounted adjacent to the D ring on the structure can give an indication of whether the hook is engaged with the D ring, and thus whether the safety device is in use.

A microprocessor suitable for use in embodiments hereof such as described above, or alternatives thereto, includes any that contains a circuit of sufficient capacity to be programmable with the necessary instructions stored in its memory, to be able to accept the necessary digital data as input, and to be able to process that data in the manner necessary to instruct the switch to either deactivate the alarm or enable movement of the moveable part. Control of the switch can be furnished through a digital actuator that receives instructions from the microprocessor and contains a driver capable of accepting the instructions from the microprocessor and either opening the alarm circuit, or closing the circuit that supplies energy to the instrument to move the moveable component.

In yet other embodiments of the subject matter hereof, there is described a method as follows: in a dangerous instrument having a movable component and a safety device, wherein engagement of the safety device reduces the danger presented by the instrument, and/or by movement of the moveable component, a method of increasing utilization of the safety device by an operator of the instrument, including (a) providing, in the instrument, an alarm that is activated by movement of the moveable component, a switch to deactivate the alarm, and an actuator to operate the switch, (b) engaging the safety device, and (c) manipulating the actuator to cause the switch to deactivate the alarm. In embodiments such as these or variations thereof, the actuator can be external to the switch. In embodiments such as these or variations thereof, the step of manipulating the actuator can be performed separately from, and/or in furtherance of or in addition to, and/or after the other steps in the method.

In yet other embodiments of the subject matter hereof, there is described a method as follows: in a dangerous instrument having a movable component and a safety device, wherein engagement of the safety device reduces the danger presented by the instrument, and/or by movement of the moveable component, a method of increasing utilization of the safety device by an operator of the instrument, including (a) providing, in the instrument, a switch to enable movement of the moveable component, and an actuator to operate the switch; (b) engaging the safety device; and (c) manipulating the actuator to cause the switch to enable movement of the moveable part. In embodiments such as these or variations thereof, the actuator can be external to the switch. In embodiments such as these or variations thereof, the step of manipulating the actuator can be performed separately from, and/or in furtherance or addition to, and/or after the other steps in the method.

An instrument, moveable component, safety device, switch, and/or actuator such as described above are suitable for use in the foregoing method embodiments hereof.

Figure 3:
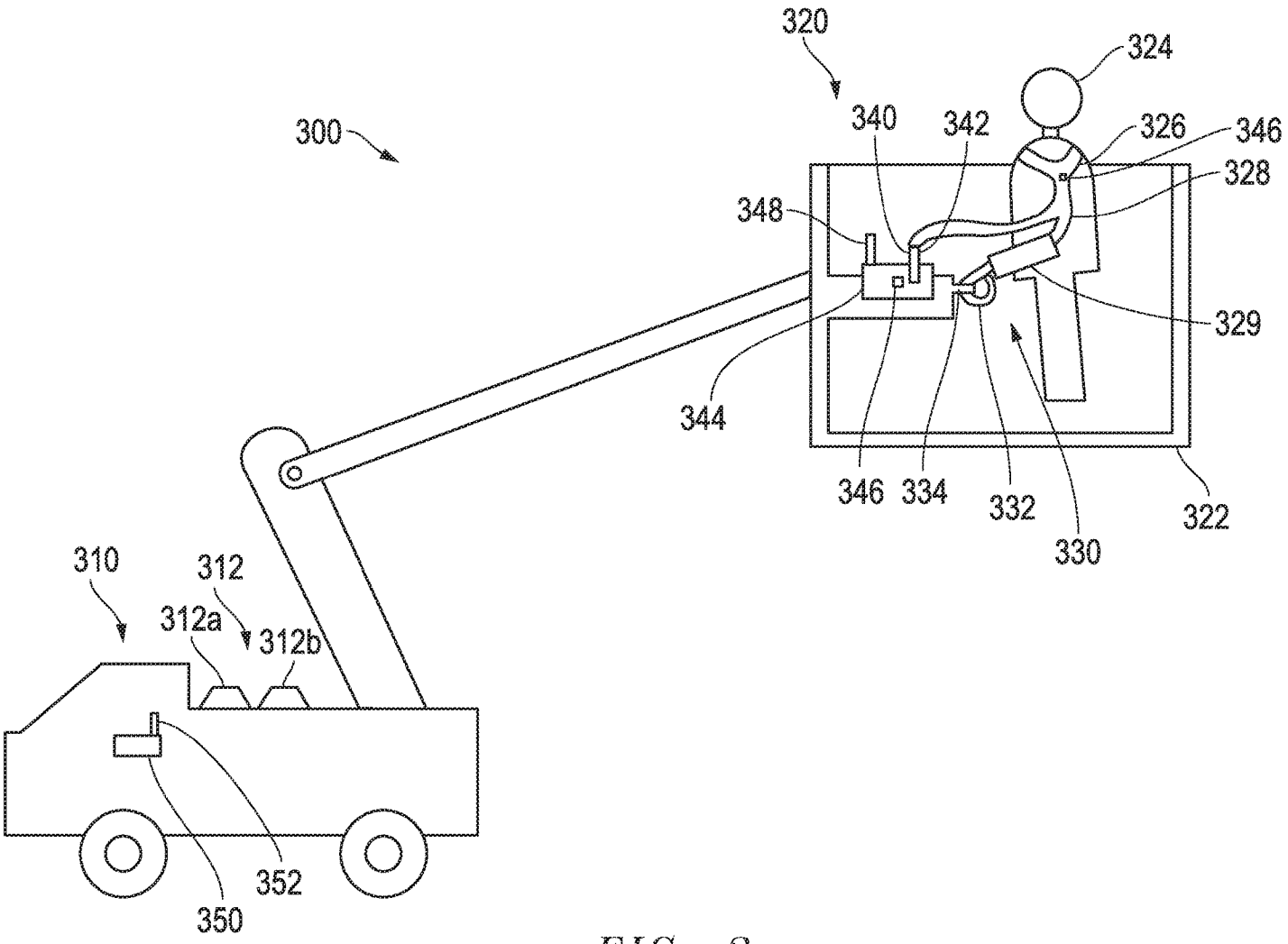
FIG. 3 shows a schematic diagram of an exemplary embodiment of aerial safety device and fall restraint system.

FIG. 3 shows a schematic diagram of an alternative exemplary embodiment of the aerialift safety device and fall restraint system 300. The aerialift safety device and fall restraint system 300 may include a truck (or other commercial/industrial vehicle) 310 having a movable or airlift component 320, which may be a bucket 322. The truck 310 may have installed alarms 312 of the several types as described in the above paragraphs, wherein said alarms 312, as in the depicted embodiment, may be an audio alarm 312*a* and a visual alarm 312*b*. Inside the bucket 322 may be a human operator 324 wearing a harness 326. The harness 326 may be securely attached to, or unitary with, a lanyard 328. The lanyard 328 as illustrated is a Y-lanyard having one end attached to an engagement fixture 330 and another end attached to an actuator 340. The engagement fixture 330 may be a hook 332 which securely attaches or engages to an anchor or structure 334 installed on the bucket 322. The actuator 340 may be a metal pin 342. The lanyard or Y-lanyard 328 may further have a holster 329 to contain the actuator 340 when the actuator 340 is not in use. The lanyard or Y-lanyard 328 may contain an embedded sensor (or transmitter/reader) and/or RFID chip 346.

The bucket 322 contains a switch 344 which is configured for engaging with the actuator 340 on the lanyard 328. The switch 344 further has a sensor 346, which may be a variety of different sensors as described above, and an antenna 348. The sensor 346 may sense or determine whether the actuator 340 is engaged with the switch 344. Subsequently, the switch 344, which may include microprocessing components, may transmit a signal through the antenna 348 to a receiver 350 if conditions are met. While said receiver 350 is depicted in FIG. 3 as located on the truck 310, it is possible that the receiver 350 may be located elsewhere as well. The receiver 350 is configured to transmit a signal through a second antenna 352 to the alarms 312. Further, each receiver 350 may be synchronized with a particular or specific switch 344 so that different and/or numerous systems 300 may operate in the vicinity of each other without interfering with one another.

In the embodiment depicted in FIG. 3, prior to operating or moving the bucket 322, the human operator 324 should engage the hook 332 with the anchor or structure 334 and also insert the metal pin 342 into the switch 344. The sensor 346 in the switch 344 determines that the metal pin 342 in place and no signal is transmitted from the antenna 348 of the switch 344 to the receiver 350.

In the event that the human operator 324 should fail to or neglect to engage the metal pin 342 into the switch 344 of the embodiment of FIG. 3, the sensor 346 will determine that the metal pin 342 is not in place and notifies the microprocessing components of the switch 344 accordingly. The switch 344 then transmits a signal to the receiver 350, which then activates the alarms 312*a*, 312*b* to notify the human operator 324, both audibly and visually, of the oversight. If the human operator 324 subsequently engages the metal pin 342 into the switch 344, the sensor 346 will notify the microprocessing components in the switch 344 of the changed status and the switch 344 will cease transmitting the signal to the receiver 350, or alternatively, transmit a different signal to the receiver 350, which may cause the receiver 350 to cease activation of the alarms 312*a*, 312*b*.

Alternatively, instead of utilizing a sensor 346, the actuator 340 or metal pin 342 may serve to complete an electromagnetic circuit when the metal pin 342 is inserted into the switch 344. This completion of the electromagnetic circuit or disruption in the circuit may also serve to notify the switch 344 of the status of the metal pin 342 and whether to notify the receiver 350 to activate the alarms 312, in place of the sensor 346.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. An apparatus for personal protection from dangers potentially associated with using a mechanized instrument in situations in which bodily restraint is needed, comprising:

(a) an alarm to warn of a dangerous situation;

(b) a switch to deactivate the alarm, wherein the switch further comprises a sensor;

(c) an actuator to operate the switch, wherein the actuator comprises a metal pin;

(d) an engagement fixture that engages a safety device with a structure at a point of engagement;

(e) an antenna mounted proximate the switch;

(f) wherein the safety device comprises a harness adapted to receive a human operator, wherein the harness is contiguous with a Y-lanyard, wherein the harness is adapted to be worn on any potentially received human operator and the Y-lanyard is distal from and worn on the potentially received human operator;

(g) a holster with a holder mounted on the lanyard;

wherein the engagement fixture is on an end of the Y-lanyard;

wherein the metal pin is on another end of the Y-lanyard;

wherein in a first position the metal pin is inserted into the switch, and wherein in a second position the metal pin is engaged in the holder of the holster;

wherein engagement of the safety device reduces the danger presented by the situation; and wherein the metal pin constitutes a first component, and the engagement fixture constitutes a second, separate component.

2. The apparatus according to claim 1 wherein the metal pin contacts the switch to operate the switch.

3. The apparatus according to claim 1 wherein the metal pin creates a magnetic field, and the sensor detects the magnetic field.

4. The apparatus according to claim 3 wherein the sensor detects motion of the magnetic field.

5. The apparatus according to claim 1 wherein the engagement fixture comprises two inter-cooperating parts.

6. The apparatus according to claim 5, wherein one part of the two inter-cooperating parts is attached to the safety device, and the other of the two parts is attached to the structure.

7. The apparatus according to claim 4, wherein the sensor is a RFID chip.

8. The apparatus according to claim 4, wherein the alarm comprises as audible alarm and a visual alarm mounted on a truck, and wherein the truck includes a moveable component mounted to the truck.

9. The apparatus according to claim 8, wherein the switch, the sensor and the actuator are all mounted on the moveable component.

10. The apparatus according to claim 1, wherein the moveable component comprises a bucket.

* * * * *